US009487935B2

(12) United States Patent
Waddell

(10) Patent No.: US 9,487,935 B2
(45) Date of Patent: Nov. 8, 2016

(54) DUAL-PURPOSE FOUNTAIN

(71) Applicant: John Steven Waddell, Suffolk, VA (US)

(72) Inventor: John Steven Waddell, Suffolk, VA (US)

( * ) Notice: Subject to any disclaimer, the term of this patent is extended or adjusted under 35 U.S.C. 154(b) by 228 days.

(21) Appl. No.: 14/300,253

(22) Filed: Jun. 10, 2014

(65) Prior Publication Data

US 2015/0354180 A1 Dec. 10, 2015

(51) Int. Cl.

| | |
|---|---|
| ***E03B 9/20*** | (2006.01) |
| ***E03C 1/04*** | (2006.01) |
| ***E03C 1/086*** | (2006.01) |
| *E03C 1/08* | (2006.01) |

(52) U.S. Cl.

CPC ..... *E03B 9/20* (2013.01); *E03C 1/0404* (2013.01); *E03C 1/086* (2013.01); *E03C 1/08* (2013.01); *E03C 2201/30* (2013.01)

(58) Field of Classification Search

CPC ..... E03B 9/20; E03C 1/0404; E03C 1/0405; E03C 1/048; E03C 2201/30; E03C 1/086

USPC ..... 239/24–27, 443, 444, 447, 525, 530, 239/570, 571; 137/118.07, 119.01, 119.03, 137/119.08, 801; 4/675–678

See application file for complete search history.

(56) References Cited

U.S. PATENT DOCUMENTS

| | | | | |
|---|---|---|---|---|
| 2,524,956 A | | 10/1950 | Brunetti | |
| 2,635,006 A | | 4/1953 | Richmond | |
| 2,829,645 A | * | 4/1958 | Matteson | A61C 17/0214 137/597 |
| 2,878,059 A | | 9/1959 | Limle | |
| 3,079,088 A | | 2/1963 | Hermann et al. | |
| 3,133,701 A | * | 5/1964 | McClenahan | E03B 9/20 137/625.16 |
| 3,208,477 A | * | 9/1965 | Gabriel | E03B 9/20 137/887 |
| 3,265,307 A | | 8/1966 | Slater, Jr. | |
| 3,325,101 A | | 6/1967 | Cuschera | |
| 3,335,957 A | * | 8/1967 | Jacobson | E03B 9/20 100/901 |
| 3,443,753 A | * | 5/1969 | McDonnell | E03B 9/20 137/119.01 |
| 3,462,080 A | | 8/1969 | Howard et al. | |
| 3,512,711 A | | 5/1970 | Abbott | |
| 3,576,309 A | * | 4/1971 | Zawacki | F16K 5/0636 137/327 |

(Continued)

FOREIGN PATENT DOCUMENTS

EP 0 787 863 A1 8/1997

OTHER PUBLICATIONS

Michelle Gann, A Crash Course in Bathroom Faucet Finishes (Sep. 25, 2013) http://web.archive.org/web/20130925044916/http://www.houzz.com/ideabooks/17686959/list/A-Crash-Course-in-Bathroom-Faucet-Finishes.*

(Continued)

*Primary Examiner* — Arthur O Hall
*Assistant Examiner* — Alexander Valvis
(74) *Attorney, Agent, or Firm* — Donald F. Mofford

(57) ABSTRACT

Disclosed is a dual-purpose faucet comprising a faucet pipe, a ball valve for gradually blocking and unblocking the faucet pipe at the free end thereof, and a fountain check valve extending through the upper surface of the faucet pipe from within the faucet pipe. When a fluid is being discharged from the faucet pipe, and, at which point, as the control means is operated so as to block the faucet pipe, the backpressure created as a result thereof, upon reaching a threshold pressure, causes the fountain check valve to open allowing the fluid to pass therethrough resulting in the discharge of a fluid jet therefrom; the trajectory of the fluid jet adjustable by adjusting the control means as adjusting the control means regulates the backpressure.

10 Claims, 11 Drawing Sheets

(56) References Cited

U.S. PATENT DOCUMENTS

| | | | | |
|---|---|---|---|---|
| 4,552,306 | A | 11/1985 | Litwak et al. | |
| 4,991,775 | A | 2/1991 | Huber et al. | |
| 5,195,681 | A * | 3/1993 | Chyen | E03B 9/20 239/25 |
| 5,309,582 | A * | 5/1994 | Henkin | E03C 1/00 4/596 |
| D347,760 | S | 6/1994 | Breeze | |
| 5,342,149 | A * | 8/1994 | McCabe | E21D 9/001 239/416.4 |
| 5,775,587 | A | 7/1998 | Davis | |
| 6,367,707 | B1 * | 4/2002 | Kang | E03C 1/04 239/24 |
| 7,090,144 | B2 | 8/2006 | Gross et al. | |
| 7,611,073 | B2 * | 11/2009 | Crutcher | A63H 3/003 239/211 |
| 8,397,753 | B2 | 3/2013 | Houghton | |
| 8,695,638 | B2 | 4/2014 | DiNunzio | |
| 2006/0101570 | A1 | 5/2006 | Kunkel | |
| 2007/0277891 | A1 * | 12/2007 | Frankel | E03C 1/0404 137/801 |
| 2008/0142101 | A1 | 6/2008 | Lin et al. | |
| 2011/0233296 | A1 | 9/2011 | Stude | |
| 2011/0290901 | A1 * | 12/2011 | Dittman, III | E03C 1/0404 239/24 |

OTHER PUBLICATIONS

Kohler, Faucet Finishes: Jewelry for the Bath, (Apr. 27, 2012) http://web.archive.org/web/20120427120224/http://www.us.kohler.com/us/Faucet-Finishes:-Jewelry-for-the-Bath/content/CNT300044.htm.*

* cited by examiner

DUAL-PURPOSE FOUNTAIN

BACKGROUND

Field of the Invention

The present invention relates to faucets, and more particularly to a dual-purpose faucet that, apart from serving the conventional purpose of discharging water therefrom, is designed to discharge a water jet from a dedicated spout wherein, the trajectory of the water jet is adjustable so as to be convenient for drinking.

As water is an indispensible part of one's life, faucets are indispensible part of one's household. Faucets are installed in various places within a household such as, in kitchen, bathroom, lavatory, dining room, etc., and serve a multitude of purposes such as, cooking, shaving, brushing, washing hands, etc. Owing to the fact that water is discharged from a downspout in a downward direction, there is however one need that is unmet by a conventional faucet, which is enabling one to directly drink, rinse one's mouth (during brushing), etc., from the downspout without the need for using a cup or 'cupping' one's hands. Therefore, in the light of this one unmet need, it would be advantageous to have a faucet to discharge water upwardly into an arc shape whereby, one can conveniently place one's open mouth directly in the line of the stream of the discharged water so as to fill one mouth with it for the purposes aforementioned. Better yet would be to have such a faucet that, apart from discharging water in the aforementioned manner, enables one to adjust the trajectory of the water jet to suit one's individual preferences such as, height, convenience, etc.

SUMMARY

The present invention comprises a dual-purpose faucet that, apart from discharging water from its downspout, generates a parabolic water jet from a dedicated fountain spout so as to enable a user to directly drink the water from the water jet. The faucet comprises a ball valve for blocking the free end of the faucet. A fountain check valve is provided, which includes the aforementioned fountain spout, such that, the fountain check valve is sensitive to a threshold pressure. As the water is being discharged from the downspout of the faucet, and at this point, as the free end of the faucet is blocked by the ball valve, the backpressure created as a result thereof, upon reaching a threshold pressure, enables fountain check valve to open and eventually discharge a water jet therefrom.

Other objects and advantages of the embodiments herein will become readily apparent from the following detailed description taken in conjunction with the accompanying drawings.

FIGURES—REFERENCE NUMERALS

10—Dual-Purpose Faucet
12—Faucet Pipe
14—Ball Valve
16—Holed Ball
18—Washer Seat
20—Handle
22—Fountain Check Valve
24—Fountain Spout
26—Water Jet
28—Dowel Pin
30—Compression Spring
32—O-ring
34—Block Ball
36—Set Nut
38—Water
40—Downspout

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The present invention comprises a dual-purpose faucet that, apart from conventionally discharging water from its downspout for utilitarian purposes, discharges a water jet (or water fountain) from a dedicated fountain spout so as to enable a user to drink water directly from the water jet without the need for using a cup, or the like. Further, a control means is employed by the faucet so as to enable the user to adjust the trajectory of the water jet to suit his/her individual preferences such as, height, convenience, etc., so as to be convenient for drinking.

Figure 1:
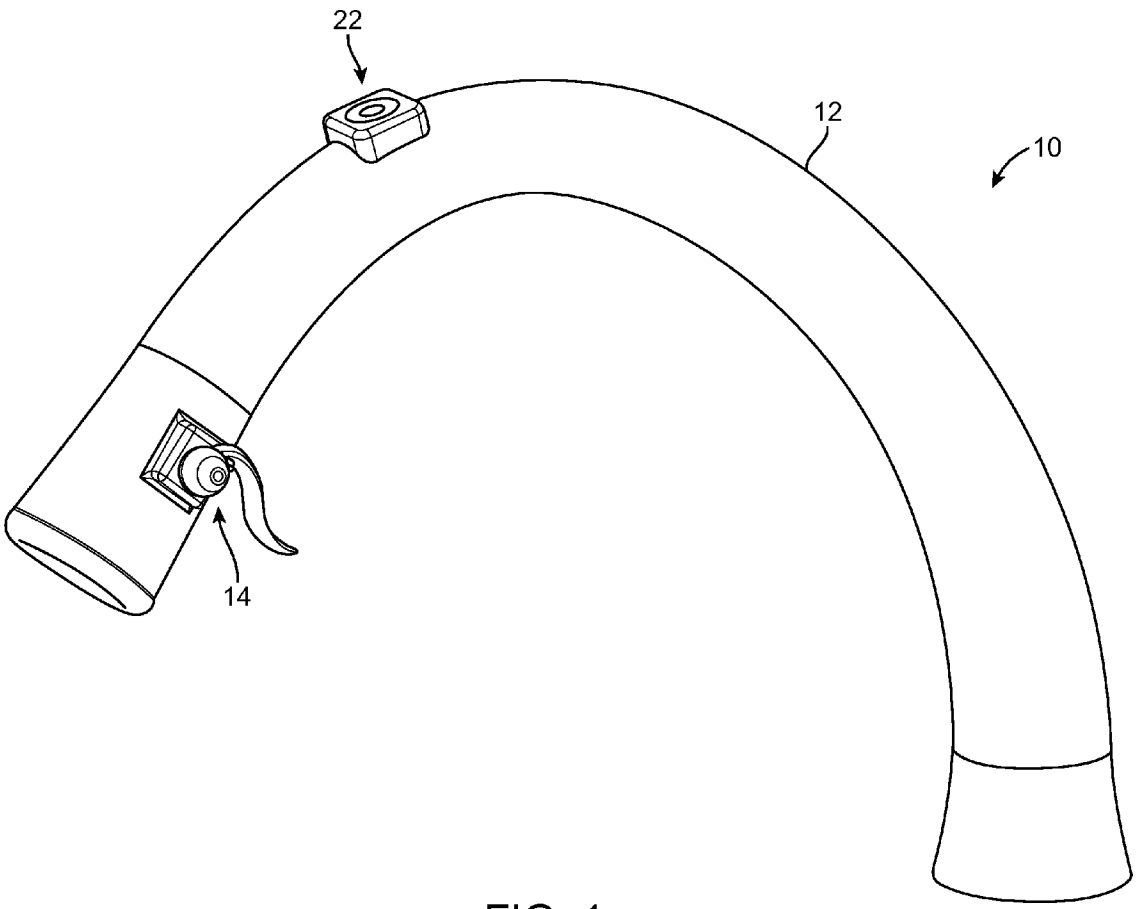
FIG. 1, according to an embodiment of the present invention, is an illustration of a perspective view of the dual-purpose faucet.
Figure 3:
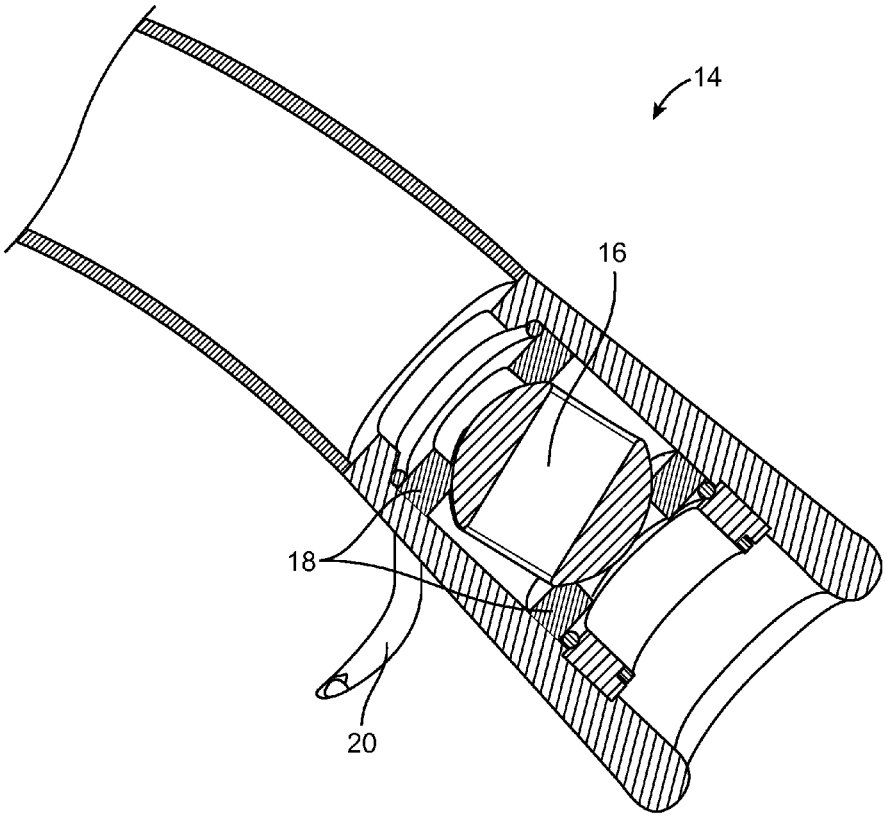
FIG. 3, according to an embodiment of the present invention, is a closer of view of FIG. 2 focusing on the ball valve.

Referring to FIGS. 1 and 3, the faucet 10 comprises a substantially inverted U-shaped faucet pipe 12 fitted from to a water source. The faucet pipe 12 is preferably of uniform annular cross-section. The free end of the faucet pipe 12 is fitted with a ball valve 14 comprising conventional ball valve components comprising a holed ball 16 disposed between a pair of seats washers 18 within the faucet pipe, and a handle 20 for operation disposed preferably at the side of the faucet pipe 12 as seen in FIG. 1. Notably, the ball valve 14 makes up the aforementioned control means wherein, the manipulation of the trajectory of the water jet by the operation of the ball valve 14 will become apparent from the following body of text. The ball valve 14, as known in the art, is operable between a closed and an open position wherein, the discharge of water from the faucet pipe 12 is allowed in the open position, and blocked in the closed position. Additionally, a faucet aerator may be fitted to the free end of the faucet pipe 12 (past the ball valve 14) for obvious reasons.

Figure 2:
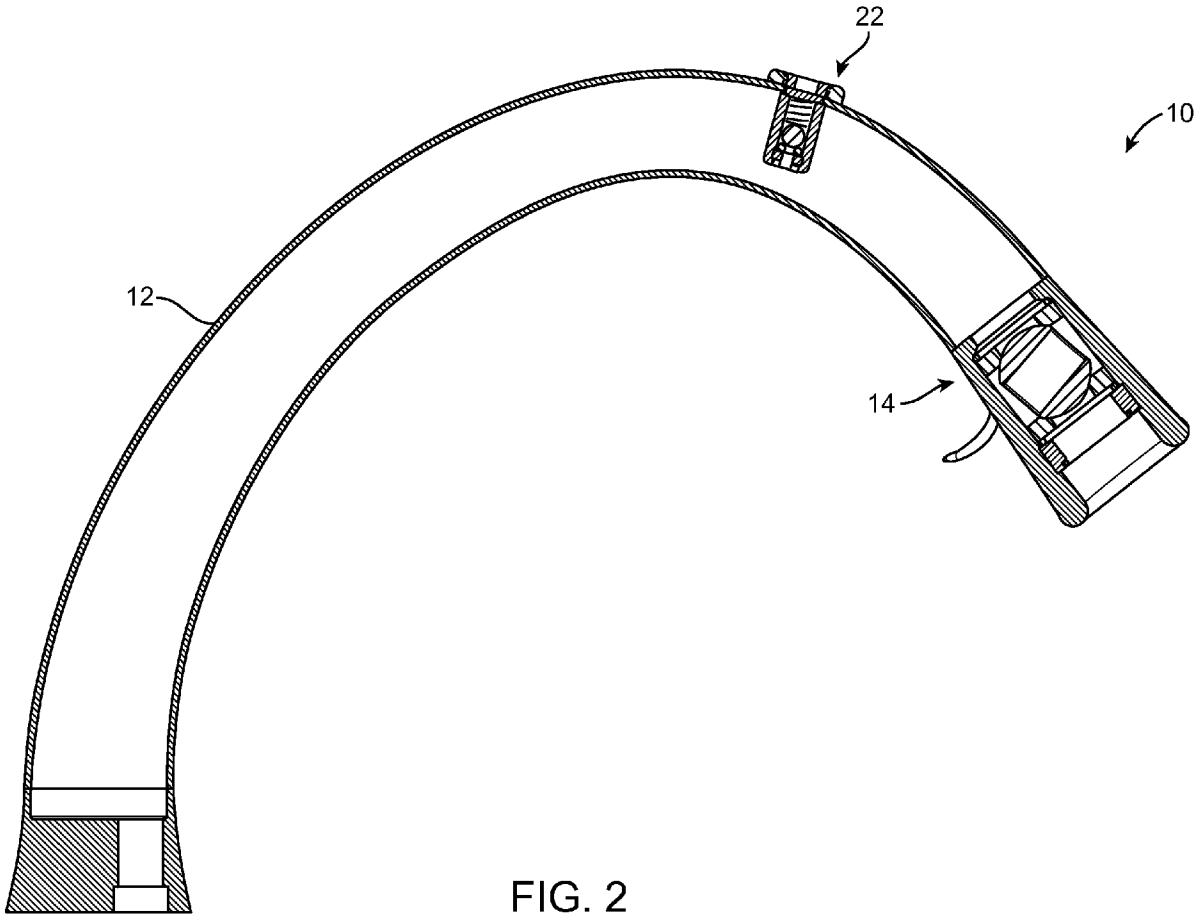
FIG. 2, according to an embodiment of the present invention, is an illustration of a side sectional view of the dual-purpose faucet.
Figure 4:
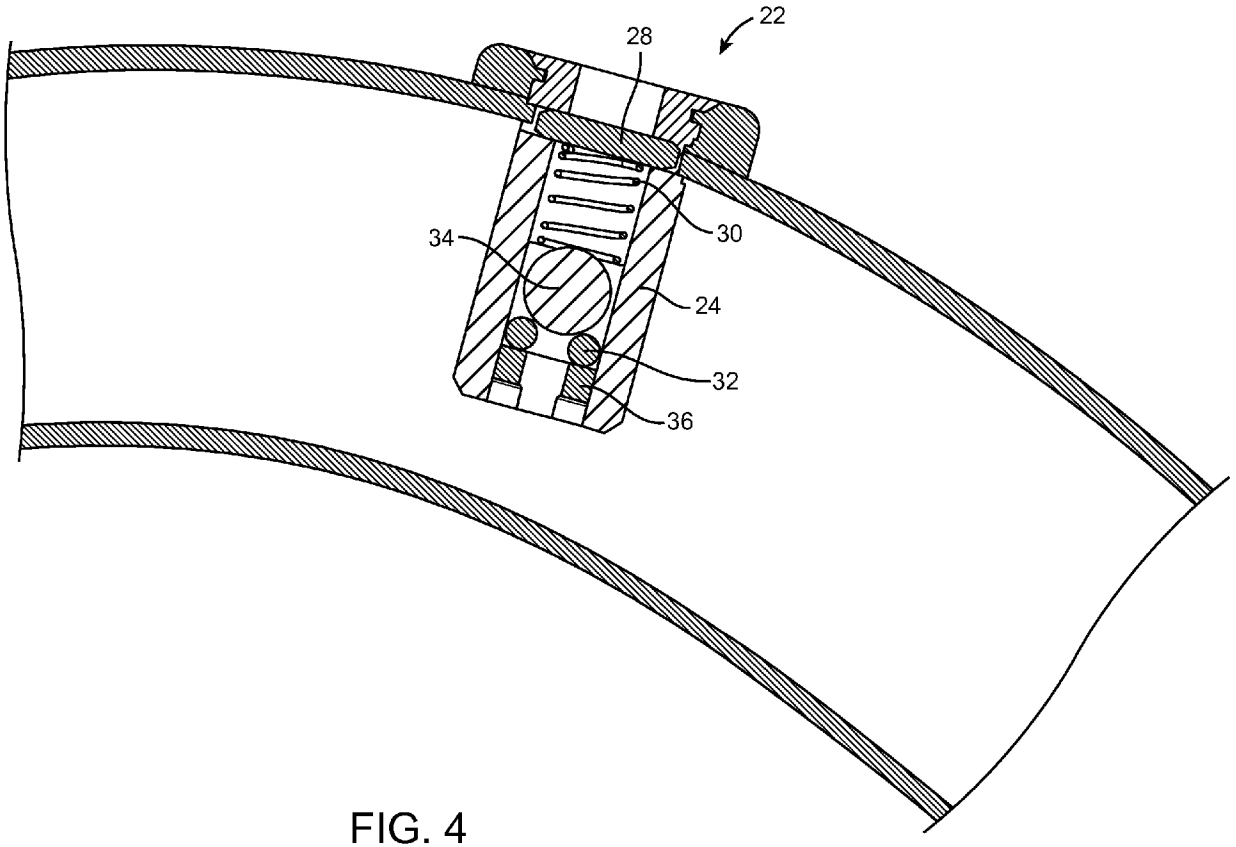
FIG. 4, according to an embodiment of the present invention, is a closer of view of FIG. 2 focusing on the fountain check valve.
Figure 5:
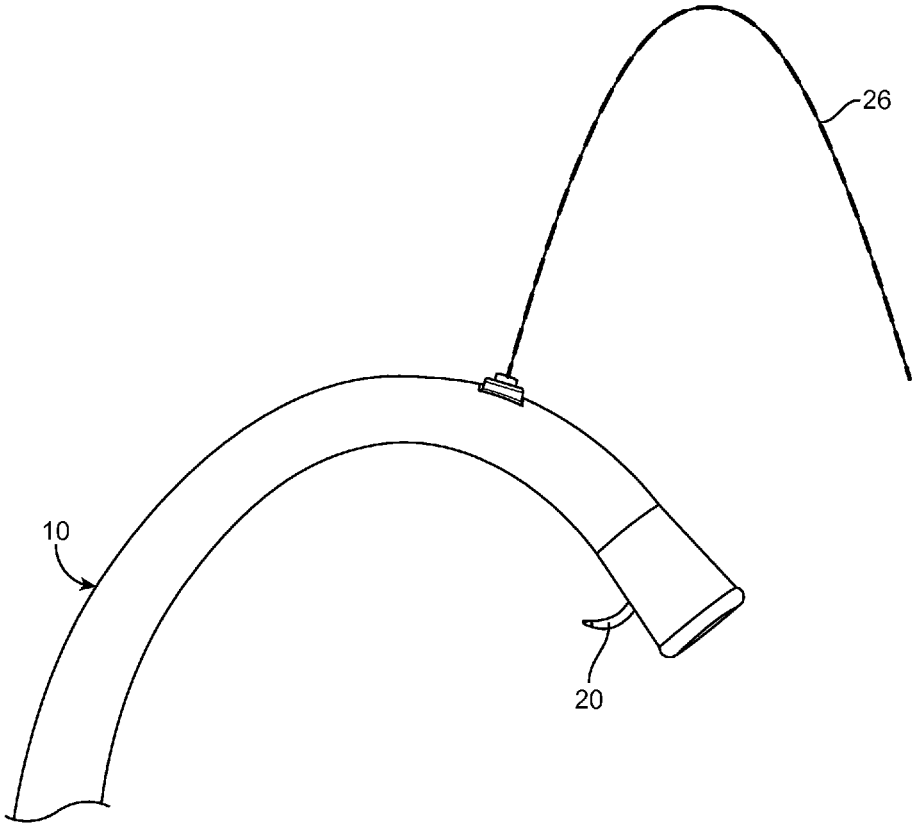
FIG. 5, according to an embodiment of the present invention, is an illustration of a side view of the dual-purpose faucet with the water jet being discharged therefrom.
Figure 6:
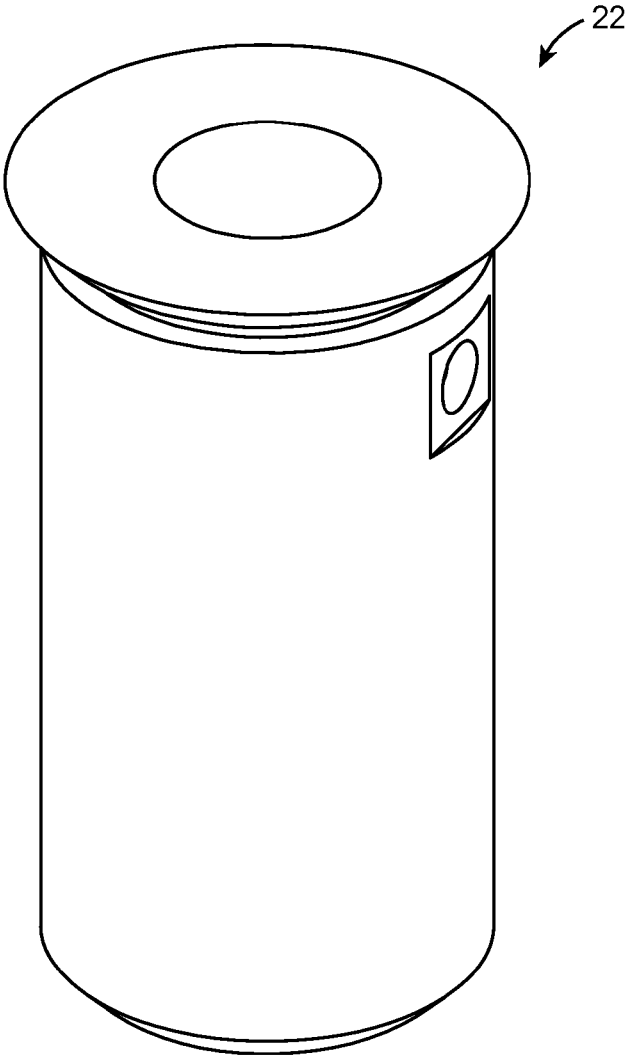
FIG. 6, according to an embodiment of the present invention, is an illustration of a perspective view of the fountain check valve.
Figure 7:
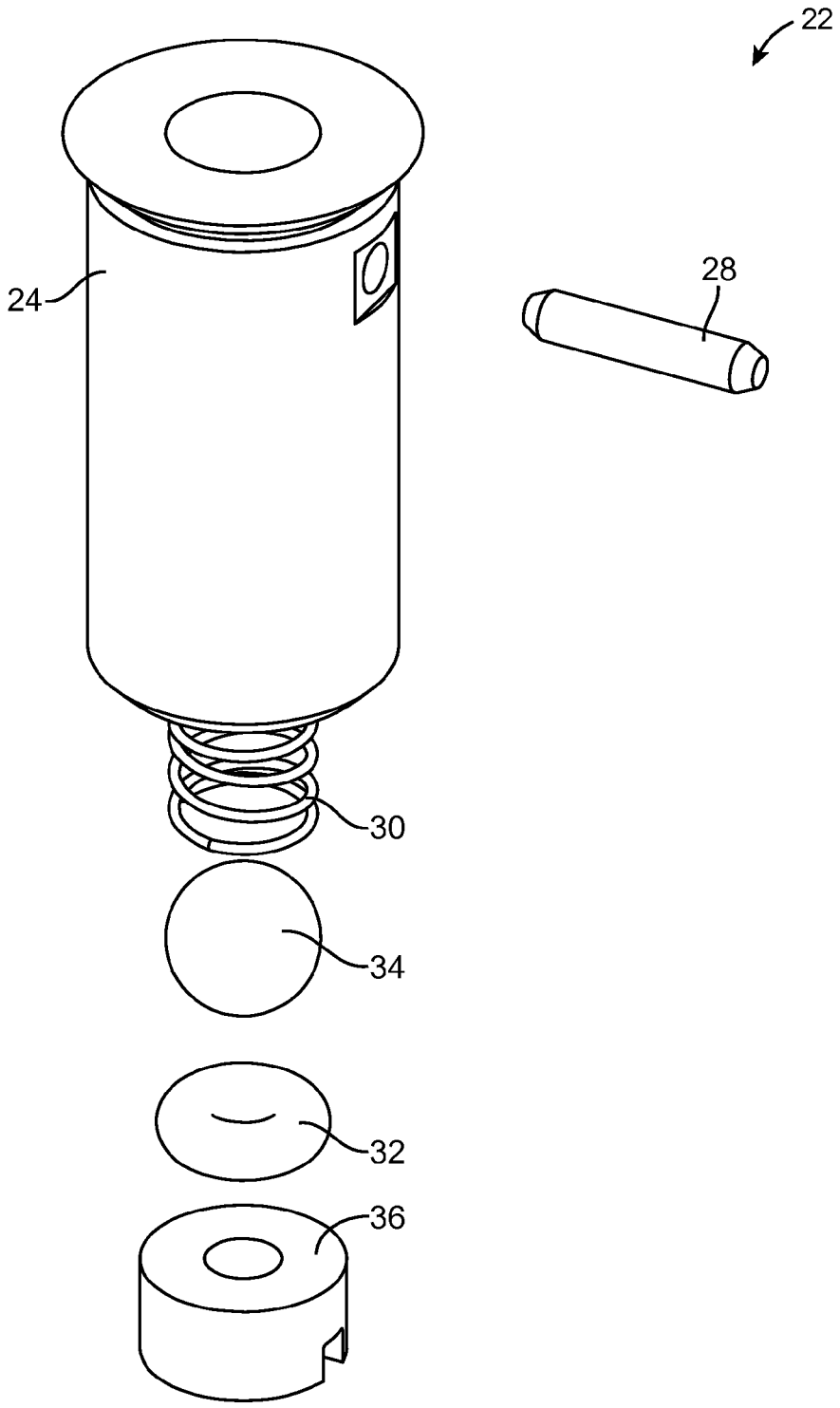
FIG. 7, according to an embodiment of the present invention, is an illustration of an exploded perspective view of the fountain check valve.
Figure 8:
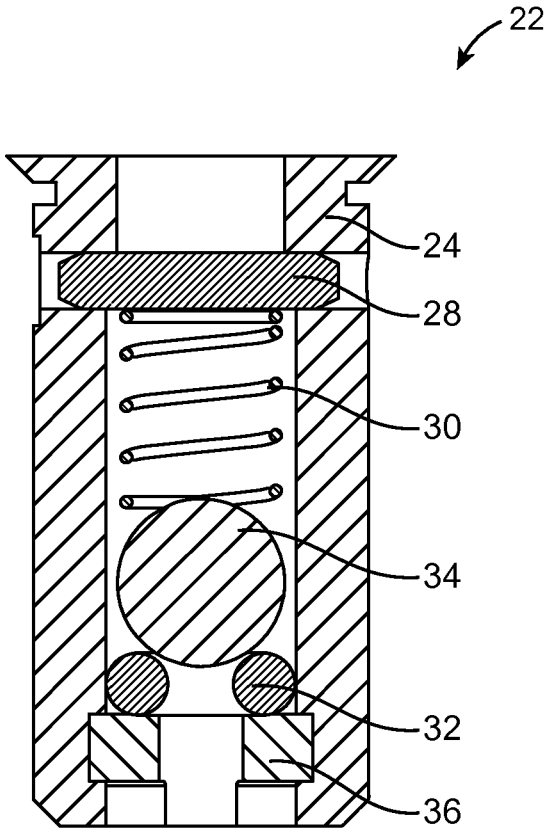
FIG. 8, according to an embodiment of the present invention, is an illustration of a side sectional view of the fountain check valve.

Referring to FIGS. 1, 2, 4 through 8, the faucet 10 further comprises a fountain check valve 22, which comprises a spring-loaded ball check valve comprising a substantially cylindrical fountain spout 24 for discharging the water jet therefrom. The upper portion of the fountain spout 24 extends upwardly through curved upper surface of the faucet pipe 12, while the rest of the fountain spout 24 is disposed within the faucet pipe 12. A portion of the surface of the faucet pipe 12 around the upper portion of the fountain spout 24 (that extends upwardly through the faucet pipe 12) is elevated such that, the upper end of the fountain spout 24 is flush with the elevated surface of the faucet pipe 12. The fountain spout 24, as seen in FIGS. 2 and 4, is forwardly tilted so as to enable the water jet 26 to be discharged in the forward direction, more particularly, in the shape of an inverted parabola as seen in FIG. 5.

Referring to FIGS. 2, 4, 6 through 8, the fountain check valve 22 further comprises a dowel pin 28 that laterally extends through the upper portion of the fountain spout 24 such that, the dowel pin 28 is perpendicular to the longitudinal axis of the fountain spout 24. A top end of a compression spring 30 is secured to the dowel pin 28 while the rest of the compression spring 30 is disposed within the fountain spout 24. The fountain check valve 22 further comprises an O-ring 32 slidably disposed within the fountain spout 24 wherein, the O-ring 32 is sealingly disposed within the fountain spout 24 as the perimeter thereof abuts the inner surface of the fountain spout 24. A spherical block ball 34 is seated over the O-ring 32 as the lower end of the compression spring 30 is pressed against the block ball 34 so as to seal the ingress of water into the fountain spout 24.

Still referring to FIGS. 2, 4, 6 through 8, the fountain check valve 22 further comprises a set nut 36 threadably secured within the fountain spout 24 at the bottom end thereof such that, the O-ring 32 rests over the set nut 36. The set nut 36 is adapted to be threadably movable so as to advance the set nut 36 in the upward and downward directions in order to regulate the force exerted by the compression spring 30 on the block ball 34 and therefore, in turn, regulate the threshold pressure required to open the fountain check valve 22. Notably, as the set nut 36 is threadably moved upward, the force exerted by the compression spring 30 on the block ball 34 gradually increases and as, the set nut 36 is threadably moved downward, the force exerted by the compression spring 30 on the block ball 34 gradually decreases.

Figure 9:
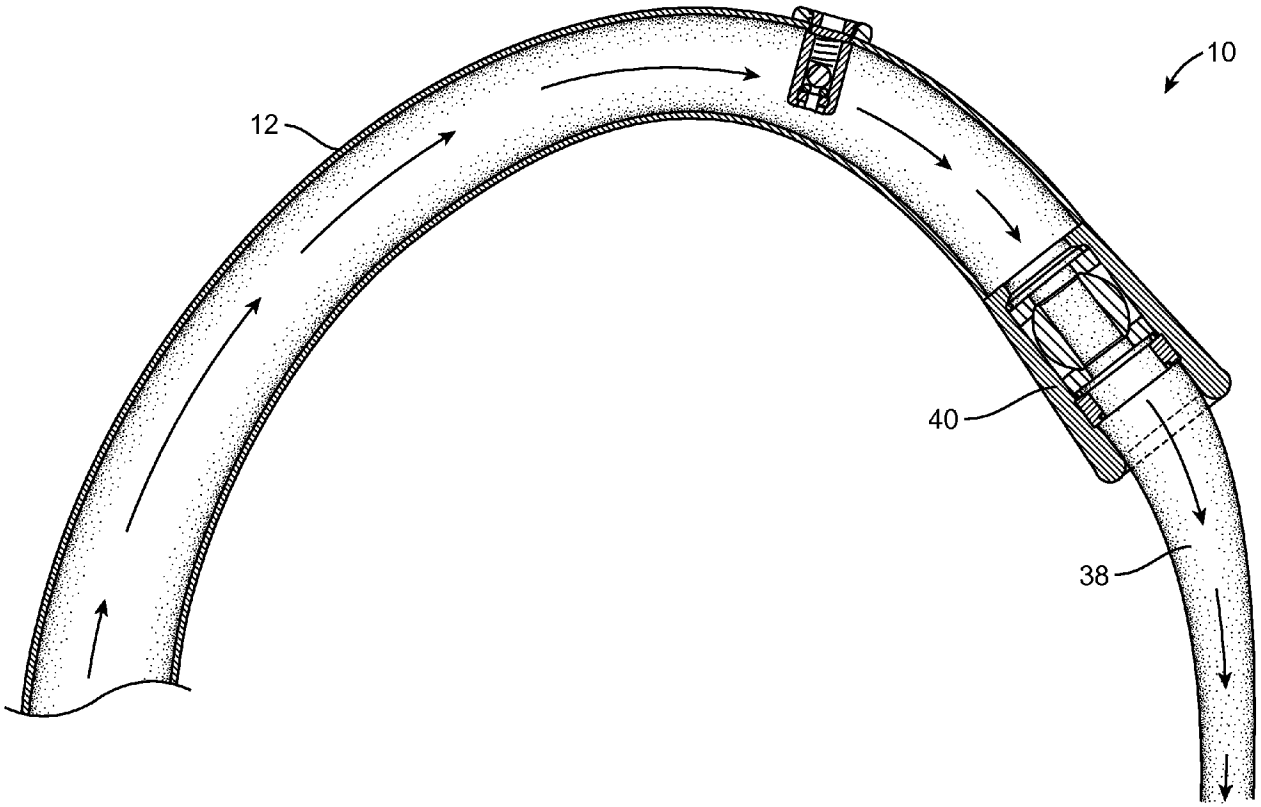
FIGS. 9 and 10, according to an embodiment of the present invention, are the sequential illustrations of the dual-purpose faucet being operated to discharge the water jet.
Figure 10:
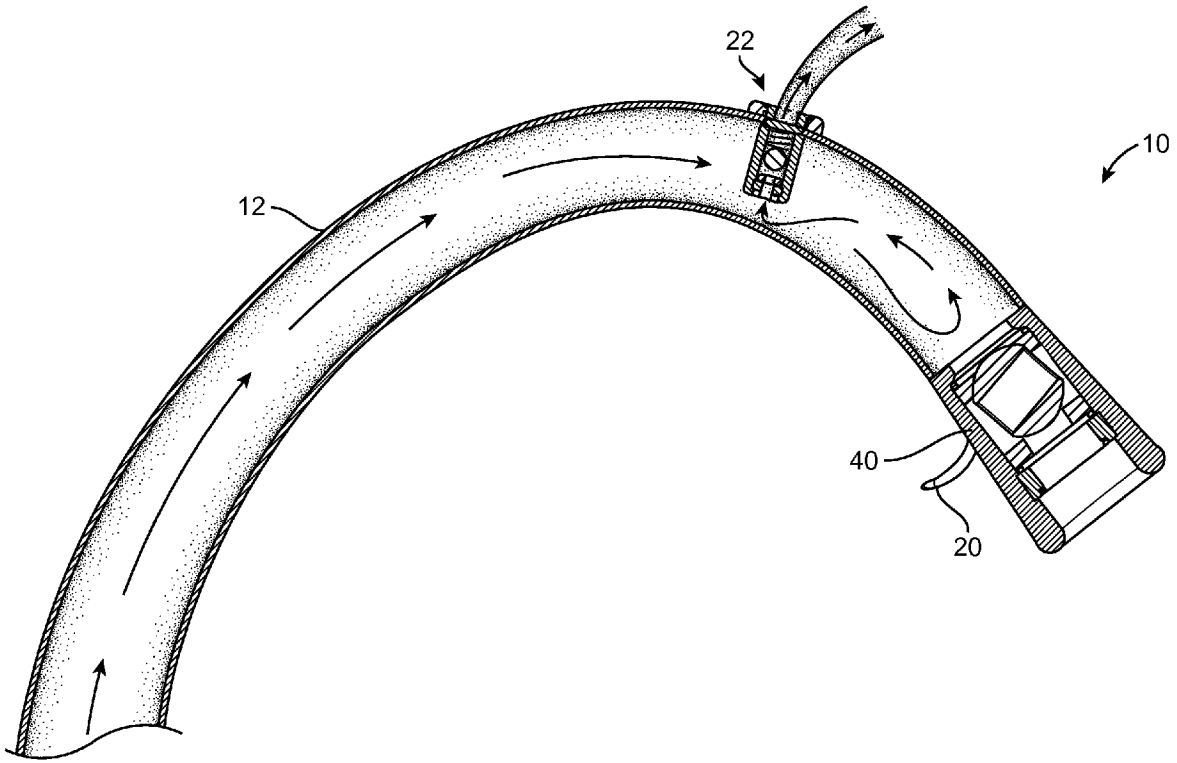
Figure 11:
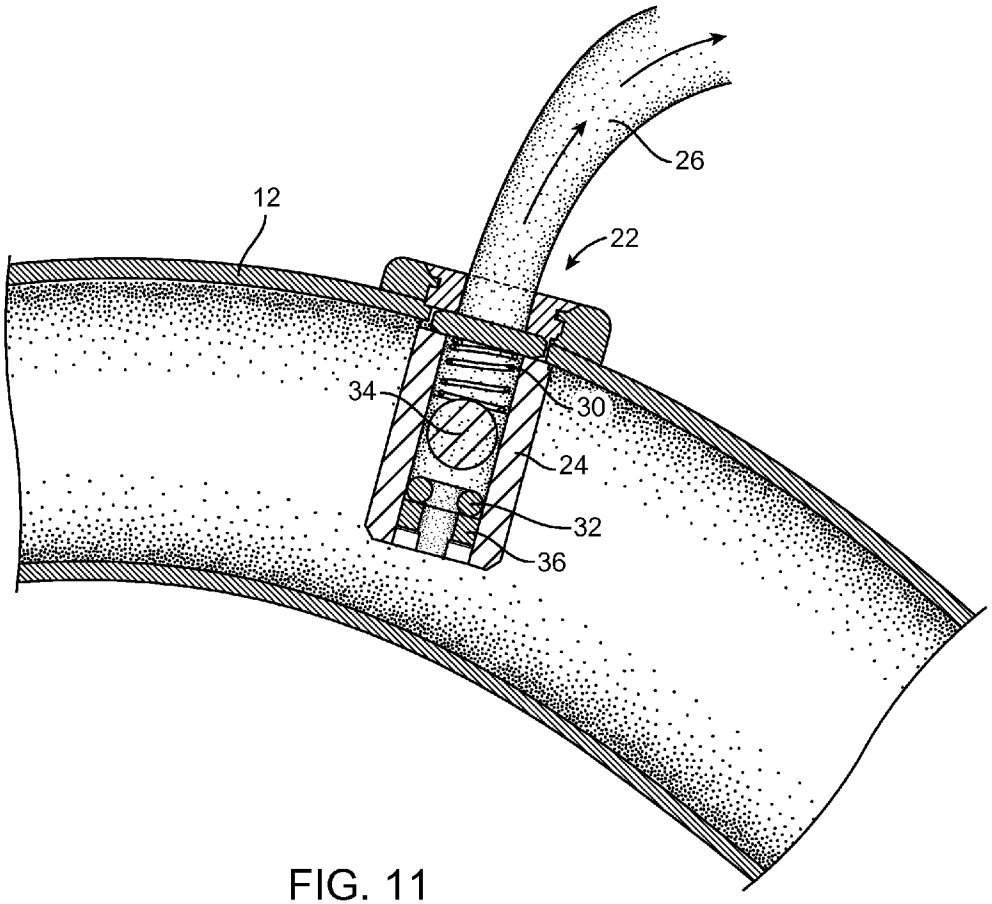
FIG. 11, according to an embodiment of the present invention, is a closer of view of FIG. 10 focusing on the fountain check valve.

Referring to FIGS. 9 through 11, as water 38 is being discharged from the downspout 40 of the faucet 10, as the ball valve 14 is closed, as well known in the art, a backpressure is created within the faucet pipe 12. The backpressure, upon reaching a threshold pressure (as regulated by the set nut 36), which normally ranges between 20 to 150 psi, causes the block ball 34 to be elevated off the O-ring 32 at which point, the water enters the fountain spout 24 so as to be eventually discharged therefrom as a water jet 26 as seen in FIG. 11. At this point, as the ball valve 14 is regulated by moving the handle 20 thereof between the closed and open position, the backpressure is simultaneously regulated so as to adjust the trajectory of the water jet 26 such as, the height, range of the water jet 26, etc.

Although, the water jet from the fountain spout is adapted to range past the faucet, there is still a good chance of the water from the fountain spout wetting the surface of the faucet pipe leading to water spotting. In order to prevent this, the exterior of the faucet pipe has a matte finish. In an alternate embodiment, the exterior surface of the faucet pipe has a physical vapor deposition (PVD) finish to not only prevent the surface of the faucet from water spotting but also from the formation of tarnish, scratches, corrosion, etc. For hygienic reasons, the faucet of the present invention, when used in hospitals, hotels, etc., the opening of the fountain spout may be sealed with a tape when not in use.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A dual-purpose faucet comprising:

(a) a faucet pipe having a free end to dispense water for utilitarian purposes and a fountain check valve to enable a user to drink water directly from a water stream discharged from the fountain check valve, wherein, the fountain check valve comprises a ball check valve and the ball check valve comprises a spring-loaded ball check valve;

(b) a ball lever valve for gradually blocking and unblocking the free end of the faucet pipe to control a trajectory of the water stream discharged from the fountain check valve; and (c) the fountain check valve extending through an upper surface of the faucet pipe from within the faucet pipe and forwardly tilted; wherein, when water is being forwardly discharged from the faucet pipe, and, at which point, as the ball lever valve is operated so as to block the faucet pipe, a backpressure created as a result thereof, upon reaching a threshold pressure, causes the fountain check valve to open allowing the water to pass therethrough resulting in a discharge of a water jet therefrom to provide the water stream; the trajectory of the water jet adjustable by adjusting the ball lever valve; wherein, the spring loaded ball check valve comprises:

(i) a fountain spout extending through the upper surface of the faucet pipe from within the faucet pipe, an inner surface of the fountain spout being cylindrical;

(ii) an O-ring slidably disposed within the fountain spout, a perimeter of the O-ring sealingly abutting the inner surface of the fountain spout;

(iii) a spherical block ball seated over the O-ring so as to seal an access into the fountain spout; and (iv) a compression spring disposed within the fountain spout, the compression spring for pressing the block ball against the O-ring; wherein, the back pressure, upon reaching the threshold pressure, acts upon the block ball causing the block ball to be elevated off the O-ring against a force exerted thereon by the compression spring thereby causing the water to pass through the fountain spout, wherein, the amount of force exerted by the compression spring on the block ball is adjustable and wherein, the fountain check valve further comprises a ring member secured at a bottom end of the fountain spout such that, the ring member abuts the O-ring; the ring member adapted to be upwardly and downwardly movable within the fountain spout so as to regulate the force exerted by the compression spring on the block ball as the block ball is simultaneously moved in keeping with a movement of the ring member.

2. The faucet of claim 1 wherein, while a bottom end of the compression spring is pressed against the block ball, a top end of the compression spring is secured to a dowel pin that laterally extends through a top portion of the fountain spout such that, the dowel pin is on a perpendicular axis of a longitudinal axis of the fountain spout; the dowel pin for holding the compression spring in place.

3. The faucet of claim 1 wherein, the O-ring is disposed at a bottom portion of the fountain spout.

4. The faucet of claim 1 wherein, the ring member comprises a set nut threadably secured to the fountain spout.

5. The faucet of claim 1 wherein, a portion of the surface of the faucet pipe around the fountain spout is elevated such that, a top of the fountain spout is flush with an elevated surface.

6. The faucet of claim 1 wherein, an exterior surface of the faucet pipe has a matte finish.

7. The faucet of claim 1 wherein, the exterior surface of the faucet pipe has a physical vapor deposition finish.

8. The faucet of claim 1 wherein, the faucet pipe comprises an inverted U-shaped member.

9. A dual-purpose faucet comprising:

(a) a faucet pipe having a free end to dispense fluid for utilitarian purposes and a spring-loaded ball check valve to enable a user to drink fluid directly from a fluid stream discharged from the spring-loaded ball check valve;

(b) a control means operable for gradually blocking and unblocking the free end of the faucet pipe to control a trajectory of the fluid stream discharged from the spring-loaded ball check valve; and (c) the spring-loaded ball check valve extending through an upper surface of the faucet pipe from within the faucet pipe; wherein, when a fluid is being discharged from the faucet pipe, and, at which point, as the control means is operated so as to block the faucet pipe, a backpressure created as a result thereof, upon reaching a threshold pressure, causes the spring-loaded ball check valve to open allowing the fluid to pass therethrough resulting in a discharge of a fluid jet therefrom to provide the fluid stream; the trajectory of the fluid jet adjustable by adjusting the control means, wherein, the spring-loaded ball check valve comprises:

(i) a fountain spout extending through the upper surface of the faucet pipe from within the faucet pipe, an inner surface of the fountain spout being cylindrical;

(ii) an O-ring slidably disposed within the fountain spout, the perimeter of the O-ring sealingly abutting the inner surface of the fountain spout;

(iii) a spherical block ball seated over the O-ring so as to seal an access into the fountain spout; and (iv) a compression spring disposed within the fountain spout, the compression spring for pressing the block ball against the O-ring; wherein, the back pressure, upon reaching the threshold pressure, acts upon the block ball causing the block ball to be elevated off the O-ring against a force exerted thereon by the compression spring causing the fluid to pass through the fountain spout wherein, the spring-loaded ball check valve further comprises a set nut threadably secured within and at a bottom end of the fountain spout such that, the set nut abuts the O-ring; the set nut adapted to be upwardly and downwardly movable within the fountain spout so as to regulate the force exerted by the compression spring on the block ball as the block ball is simultaneously moved in keeping with a movement of the set nut.

10. A dual-purpose faucet comprising:

(a) a faucet pipe having a free end to dispense fluid for utilitarian purposes and a spring-loaded ball check valve to enable a user to drink fluid directly from a fluid stream discharged from the spring-loaded ball check valve;

(b) a control means operable for gradually blocking and unblocking the free end of the faucet pipe to control a trajectory of the fluid stream discharged from the spring-loaded ball check valve; and (c) a spring-loaded ball check valve comprising:

(i) a fountain spout extending through an upper surface of the faucet pipe from within the faucet pipe, an inner surface of the fountain spout being cylindrical;

(ii) an O-ring slidably disposed within the fountain spout, the perimeter of the O-ring sealingly abutting the inner surface of the fountain spout;

(iii) a spherical block ball seated over the O-ring so as to seal access into the fountain spout;

(iv) a compression spring disposed within the fountain spout, the compression spring for pressing the block ball against the O-ring; and (v) a set nut threadably secured within and at a bottom end of the fountain spout such that, the set nut abuts the O-ring, the set nut adapted to be upwardly and downwardly movable within the fountain spout so as to regulate a force exerted by the compression spring on the block ball as the block ball is simultaneously moved in keeping with a movement of the set nut;

wherein, when a fluid is being discharged from the faucet pipe, and, at which point, as the control means is operated so as to block the faucet pipe, a backpressure created as a result thereof, upon reaching a threshold pressure, causes the block ball to be elevated off the O-ring against the force exerted thereon by the compression spring causing the fluid to pass through the fountain spout resulting in the discharge of a fluid jet from the outlet of the fountain spout to provide the fluid stream; the trajectory of the fluid jet adjustable by adjusting the control means as adjusting the control means regulates the backpressure.

* * * * *